US011053644B2

(12) United States Patent
Philipp

(10) Patent No.: US 11,053,644 B2
(45) Date of Patent: Jul. 6, 2021

(54) TAMPING UNIT FOR TAMPING SLEEPERS OF A TRACK

(71) Applicant: Plasser & Theurer Export von Bahnbaumaschinen Gesellschaft m.b.H., Vienna (AT)

(72) Inventor: Thomas Philipp, Leonding (AT)

(73) Assignee: Piasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 337 days.

(21) Appl. No.: 16/345,007

(22) PCT Filed: Oct. 30, 2017

(86) PCT No.: PCT/EP2017/001266
§ 371 (c)(1),
(2) Date: Apr. 25, 2019

(87) PCT Pub. No.: WO2018/095558
PCT Pub. Date: May 31, 2018

(65) Prior Publication Data

US 2019/0271119 A1 Sep. 5, 2019

(30) Foreign Application Priority Data

Nov. 25, 2016 (AT) ..... A 533/2016

(51) Int. Cl.
*E01B 27/16* (2006.01)
*B06B 1/18* (2006.01)

(52) U.S. Cl.
CPC ..... *E01B 27/16* (2013.01); *B06B 1/18* (2013.01)

(58) Field of Classification Search
CPC ..... E01B 27/16; E01B 27/17; E01B 27/18; E01B 27/20; B06B 1/18
See application file for complete search history.

(56) References Cited

U.S. PATENT DOCUMENTS 2,587,324 A * 2/1952 Hursh ..... E01B 27/17 104/12
2,872,878 A * 2/1959 Plasser ..... E01B 27/16 104/12

(Continued)

FOREIGN PATENT DOCUMENTS

AT 350 097 B 5/1979
DE 26 52 760 A1 5/1977

(Continued)

OTHER PUBLICATIONS

International Search Report of PCT/EP2017/001266, dated Jan. 26, 2018.

*Primary Examiner* — Jason C Smith
(74) *Attorney, Agent, or Firm* — Collard & Roe, P.C.

(57) ABSTRACT

The invention relates to a tamping unit (1) for tamping sleepers (3) of a track (4), comprising oppositely positioned tamping tools (14, 17) which are connected in each case to a squeezing cylinder (9, 15) for generating a squeezing motion, wherein an eccentric drive (11) is provided for generating a vibratory motion. In this, it is provided that a first squeezing cylinder (9) is connected mechanically to the eccentric drive (11), and that a first pressure chamber (18) of the first squeezing cylinder (9) is connected hydraulically via a connecting line (22, 27) to a second pressure chamber (20) of a second squeezing cylinder (15) in order to transmit a pressure change, generated in the first pressure chamber (18) by means of the eccentric drive (11), to the second pressure chamber (20).

7 Claims, 4 Drawing Sheets

(56) References Cited

U.S. PATENT DOCUMENTS

| | | | | | |
|---|---|---|---|---|---|
| 3,211,064 | A | * | 10/1965 | Plasser | E01B 27/16 91/536 |
| 3,981,247 | A | * | 9/1976 | Theurer | E01B 27/16 104/12 |
| 4,240,352 | A | | 12/1980 | Theurer | |
| 4,356,771 | A | * | 11/1982 | Theurer | E01B 27/10 104/12 |
| 2006/0090666 | A1 | | 5/2006 | Theurer et al. | |
| 2019/0271119 | A1 | * | 9/2019 | Philipp | B06B 1/18 |

FOREIGN PATENT DOCUMENTS

| | | | |
|---|---|---|---|
| EP | 1 653 003 | A2 | 5/2006 |
| GB | 797 044 | A | 6/1958 |

* cited by examiner

TAMPING UNIT FOR TAMPING SLEEPERS OF A TRACK

CROSS REFERENCE TO RELATED APPLICATIONS

This application is the National Stage of PCT/EP2017/001266 filed on Oct. 30, 2017, which claims priority under 35 U.S.C. § 119 of Austrian Application No. A 533/2016 filed on Nov. 25, 2016, the disclosures of which are incorporated by reference. The international application under PCT article 21(2) was not published in English.

FIELD OF TECHNOLOGY

The invention relates to a tamping unit for tamping sleepers of a track, comprising oppositely positioned tamping tools which are connected in each case to a squeezing cylinder for generating a squeezing motion, wherein an eccentric drive is provided for generating a vibratory motion.

PRIOR ART

Tamping units for tamping sleepers of a track are already known from several examples, such as, for instance, from AT 350 097 B. Serving as a vibration exciter is a rotatable eccentric shaft to which the squeezing drives are articulatedly connected for transmitting the vibrations to the tamping tools. The advantage of a vibration drive with an eccentric lies in the energy balance of the overall system. Only so much energy is supplied as is taken up at the tamping tine or is lost through friction in the system. The storage of energy at the eccentric takes place in a flywheel or rotating mass which absorbs energy during braking of the tamping tine and, when the tamping tine is accelerated, returns energy again into the dynamic system (kinetic energy).

In a hydraulic vibration drive known, for example, from EP 1 653 003 A2, a large part of the hydraulic energy is needed for generating the vibrations. This disadvantage compared to a vibration drive with eccentric overshadows the possible advantages, such as a more simple control or a more compact design.

SUMMARY OF THE INVENTION

It is the object of the invention to indicate an improvement over the prior art for a tamping unit of the type mentioned at the beginning. The object of the invention lies particularly in providing a compact design for tamping units.

According to the invention, this object is achieved by way of a tamping unit according to claim 1. Dependent claims relate to advantageous embodiments of the invention.

The invention provides that a first squeezing cylinder is connected mechanically to the eccentric drive, and that a first pressure chamber of the first squeezing cylinder is connected hydraulically via a connecting line to a second pressure chamber of a second squeezing cylinder in order to transmit a pressure change, generated in the first pressure chamber by means of the eccentric drive, to the second pressure chamber.

The essential advantage here lies in the energy balance of the overall system since the storage effect of the eccentric drive is utilized. Thus, the advantages of the eccentric drive are combined with the advantage of a compact design, since a squeezing cylinder can be arranged independently of the eccentric drive.

An advantageous further development of the invention provides that an approximately equal relationship of force transmission from the respective squeezing cylinder to the associated tamping tool exists, and that the two squeezing cylinders are controlled in a diametrically opposed manner. In this way, each mass has a counter-mass which moves in the opposite direction. The static mass compensation thus achieved minimizes vibrations and sound emissions. Thus, a more pleasant work environment is created for the worker, as well as low-noise operation of the tamping unit in residential areas.

Additionally, it is favourable if both squeezing cylinders are oriented approximately horizontally, if the tamping tool associated with the first squeezing cylinder has a first mass moment of inertia with respect to a pivot axis, if the tamping tool associated with the second squeezing cylinder has a second mass moment of inertia with respect to a pivot axis, and if both mass moments of inertia are coordinated with one another. In this manner, a dynamic mass balancing is ensured, minimizing the vibration transmitted via an assembly suspension to a tamping machine.

A further advantageous embodiment of the invention is created in that the tamping unit is composed of several individual unit modules to form a multi-sleeper unit. Due to the compactness of the individual unit modules, these can be combined cost-effectively into multi-sleeper units. This has a positive impact both in production as well as in maintenance of the individual modules. In this, each unit module is advantageously designed structurally identically having a separate eccentric drive.

In the case of two unit modules arranged side by side, it can also be useful if two first squeezing cylinders are mechanically connected to a common eccentric drive, and if each first squeezing cylinder is hydraulically connected to a second squeezing cylinder.

A particularly advantageous embodiment provides that the connecting line is connected via a pressure diaphragm to a hydraulic system. Via said pressure diaphragm, the squeezing force and vibration of the squeezing cylinders can be adjusted.

A further useful development is realized in that an amplitude of an eccentric shaft is split evenly between both squeezing cylinders. Instead of using two individual eccentrics to control one squeezing cylinder in each case, an eccentric shaft configured with double the size can be used for both squeezing cylinders.

Additional advantages of the invention become apparent from the drawing description.

BRIEF DESCRIPTION OF THE DRAWINGS

The invention will be described by way of example below with reference to the attached figures. There is shown in.

DESCRIPTION OF THE EMBODIMENTS

Figure 1:
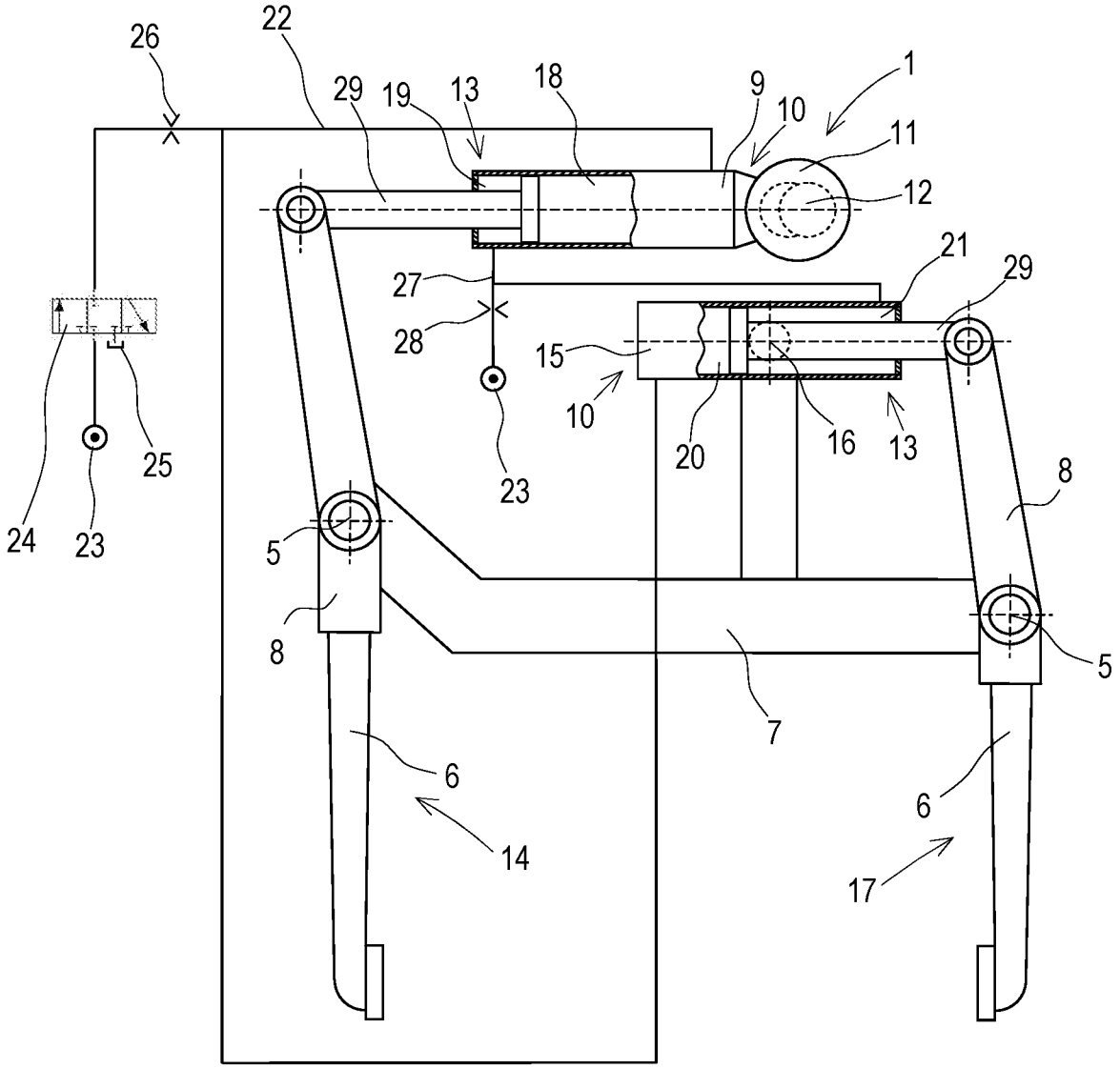
FIG. 1 a tamping unit represented in a simplified way.

A tamping unit 1, shown in a simplified manner in FIG. 1, for tamping a ballast bed 2 underneath sleepers 3 of a track 4 comprises pairs of two oppositely positioned tamping tools 14, 17 which are pivotable about a respective pivot axis 5. Specifically, each tamping tool 14, 17 is a tamping tine 6 with a tine arm 8, mounted on a tool carrier 7 and connected to a squeezing cylinder 9, 15.

A first squeezing cylinder 9 is connected at a cylinder-side end 10 to a vibration drive designed as an eccentric drive 11 having a rotating eccentric shaft 12, and at a piston-side end 13 to a first tamping tine 14. A second squeezing cylinder 15 is mounted on the tool carrier 7 for rotation on a rotary axis 16 and connected at its piston-side end 13 to a second tamping tool 17.

The first squeezing cylinder 9 has a first pressure chamber 18 and a third pressure chamber 19. The second squeezing cylinder 15 has a second pressure chamber 20 and a fourth pressure chamber 21. The first pressure chamber 18 of the first squeezing cylinder 9 is connected hydraulically to the second pressure chamber 20 of the second squeezing cylinder 15 via a first connecting line 22 in order to transmit a part of the vibration generated by means of the eccentric drive 11 to the second squeezing cylinder 15.

The first and the second squeezing cylinder 9, 15 are connected to a constant pressure supply 23 of a hydraulic system. The first connecting line 22 is connected to the constant pressure supply 23 and a tank 25 via a servo valve or proportional valve 24. With this, a squeezing pressure is controlled in the first pressure chamber 18 of the first squeezing cylinder 9 and in the second pressure chamber 20 of the second squeezing cylinder 15.

In the first pressure chamber 18 of the first squeezing cylinder 9, the squeezing pressure is superimposed by an oscillating pressure generated by means of the eccentric drive. This oscillating pressure is split between the two squeezing cylinders 9, 15 via the first connecting line 22. During this, hydraulic fluid oscillates back and forth between the first pressure chamber 18 and the second pressure chamber 20, whereby a piston rod 29 of the second squeezing cylinder 15 is also set in vibration. A flow-off in the direction of the proportional valve 24 is prevented by a first pressure diaphragm 26.

The third pressure chamber 19 of the first squeezing cylinder 9 is connected hydraulically via a second connecting line 27 to the fourth pressure chamber 21 of the second squeezing cylinder 15. Via this second connecting line 27, a volume compensation takes place which is necessary as a result of the volume increase in the first and second pressure chamber 18, 20 during a squeezing process and the superimposed oscillation of the hydraulic fluid.

The second connecting line 27 is likewise connected to the constant pressure supply 23 and has a second pressure diaphragm 28 for pressure regulation. When the piston rods 29 of the squeezing cylinders 9, 15 are pressed outward during a squeezing procedure and the tamping tools 6 are squeezed together, a volume decrease automatically ensues in the third pressure chamber 19 and in the fourth pressure chamber 21, and the hydraulic fluid is drained via the second pressure diaphragm 28.

As a result of the coordinated dimensioning of the two squeezing cylinders 9, 15, an equally great squeezing force as well as a uniform and symmetrical vibration of the tamping tools 6 is generated. In this, the amplitude of the eccentric drive 11 resulting from the rotating eccentric shaft 12 is configured to be twice as high as in conventional eccentric units, since this total amplitude is split between both squeezing cylinders 9, 15.

Figure 2:
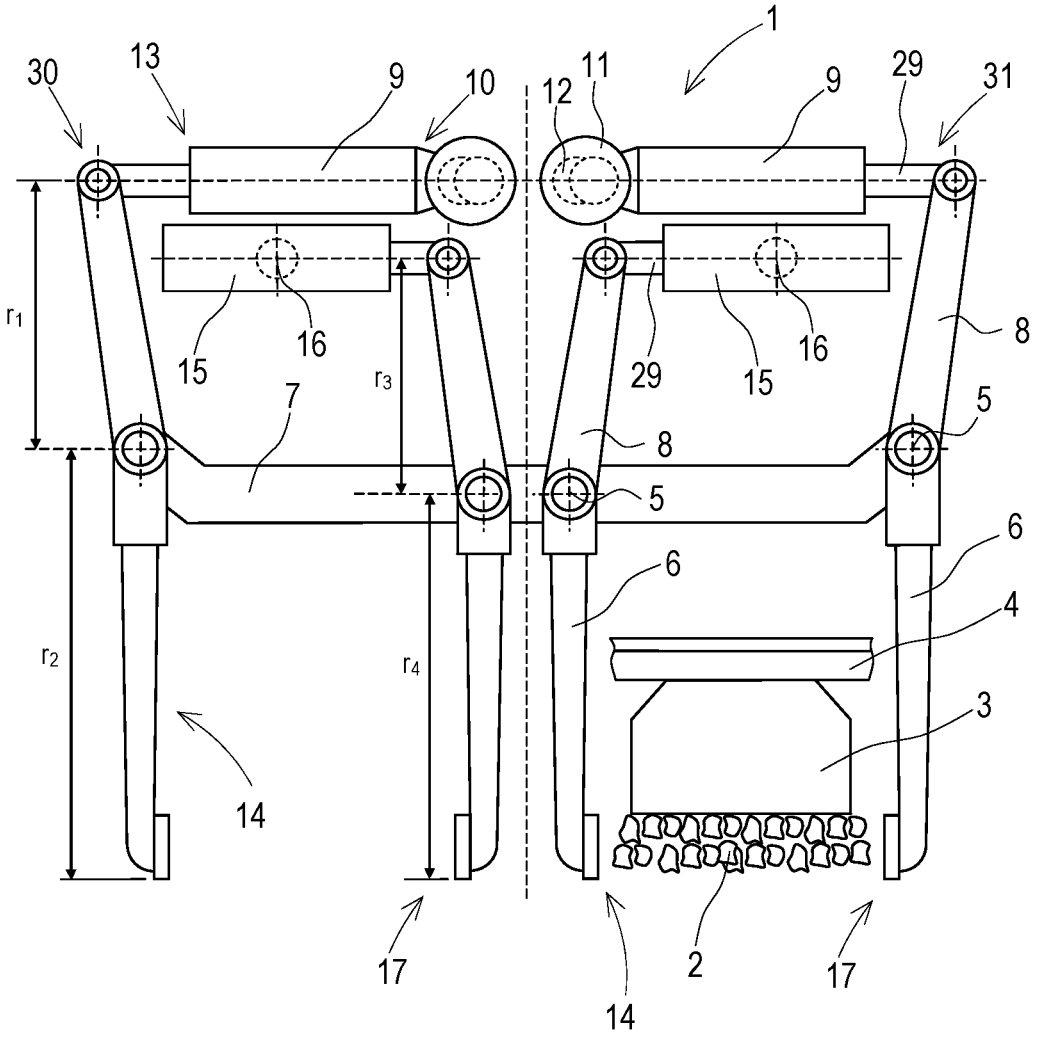
FIG. 2 a tamping unit in module design.

FIG. 2 shows a further variant of embodiment of the tamping unit 1 for the simultaneous tamping of two sleepers 3 of the track 4. To that end, a first unit module 30 and a second unit module 31 are combined into a two-sleeper tamping unit. In this, the tamping tools 14, 17 can be offset with regard to one another in a transverse direction of the track in order to avoid a collision with one another.

With reference to FIG. 2, a preferred dimensioning of the tamping unit according to the invention is explained. To that end, radii $r_1$, $r_2$ of an upper pivot lever and a lower pivot lever of the first tamping tool 14 and radii $r_3$, $r_4$ of an upper pivot lever and a lower pivot lever of the second tamping tool 17 are defined with regard to the respective pivot axis 5.

For static balance, these radii $r_1$, $r_2$, $r_3$, $r_4$ are to be in the following relationship to one another:

$$r_1/r_2=r_3/r_4$$

Then, with equally dimensioned squeezing cylinders 9, 15, equal squeezing forces act upon the ballast bed 2 to be compacted.

For dynamic balance of an individual unit module 30, 31 of the tamping unit 1, a first mass moment of inertia l1of the first tamping tool 14 about the associated pivot axis 5 and a second mass moment of inertia 12 of the second tamping tool 17 about the associated pivot axis 5 are to be taken into account.

For dynamic balance between the two tamping tools 6, the following condition must be observed:

$$r_1/l_2=r_3/l_4$$

As a result of the approximately horizontal arrangement of the squeezing cylinders 9, 15, all inertia forces thus balance out.

Figure 3:
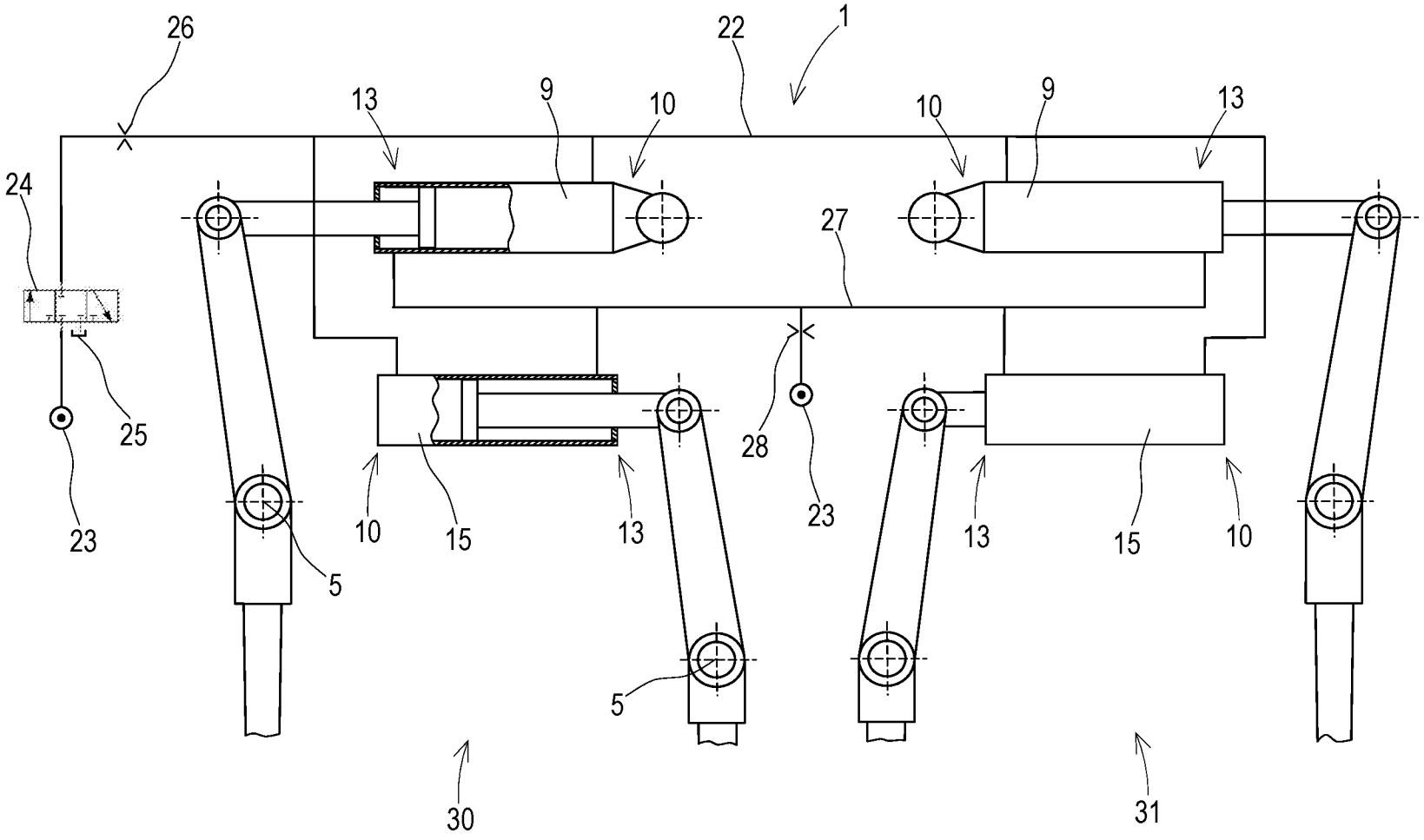
FIG. 3 a routing of the hydraulic connecting lines.

FIG. 3 shows a routing of the connecting lines 22, 27 in a combined tamping unit 1 according to FIG. 2. To that end, as in FIG. 1, there is a first hydraulic connecting line 22 which is connected in each case at the cylinder side to the first squeezing cylinders 9 and the second squeezing cylinders 15. The second connecting line 27 connects at the piston side in each case the first squeezing cylinders 9 to the second squeezing cylinders 15.

Figure 4:
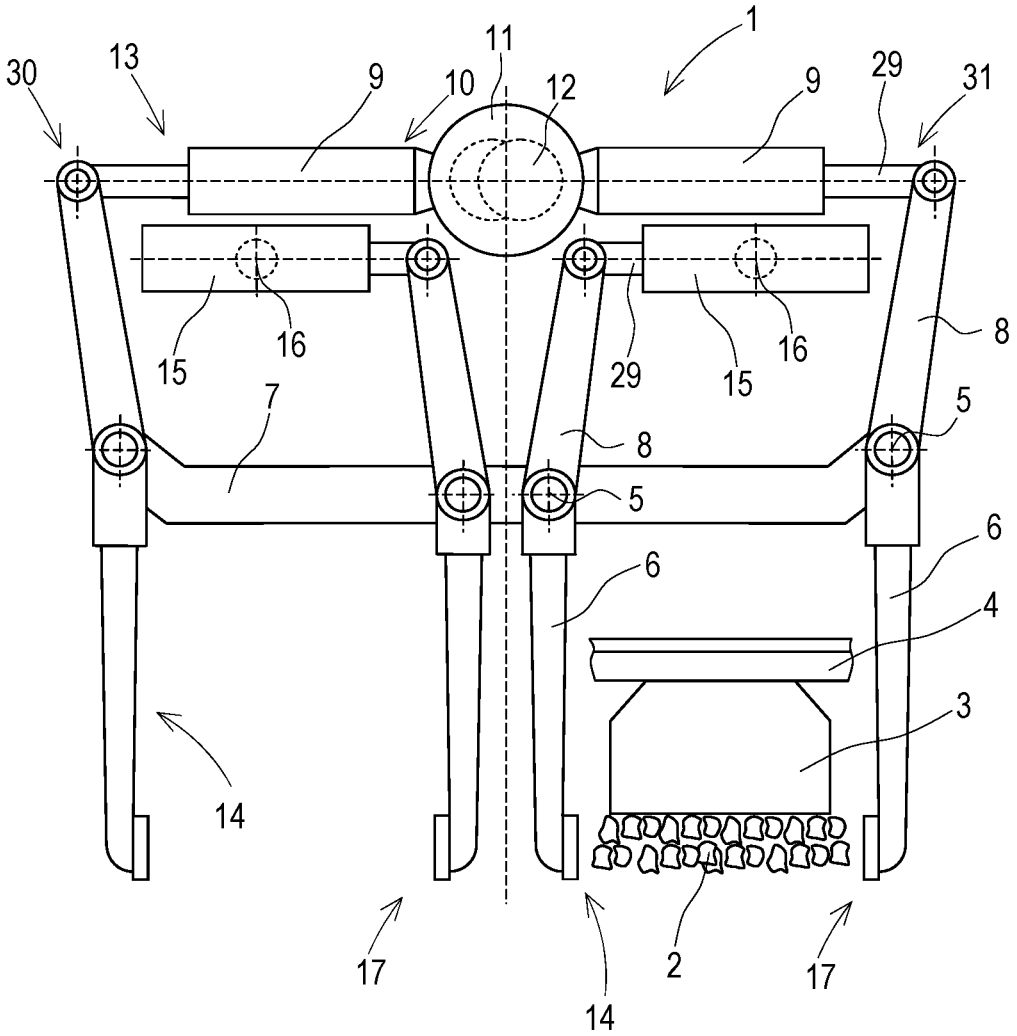
FIG. 4 a tamping unit in module design with a common eccentric drive.

In this, both first squeezing cylinders 9 are either connected to a common eccentric drive 11 (FIG. 4) or each to a separate eccentric drive 11 FIG. 2).

The invention claimed is:

1. A tamping unit (1) for tamping sleepers (3) of a track (4), comprising oppositely positioned tamping tools (14, 17) which are connected in each case to a squeezing cylinder (9, 15) for generating a squeezing motion, wherein an eccentric drive (11) is provided for generating a vibratory motion, wherein a first squeezing cylinder (9) is connected mechanically to the eccentric drive (11), and wherein a first pressure chamber (18) of the first squeezing cylinder (9) is connected hydraulically via a connecting line (22, 27) to a second pressure chamber (20) of a second squeezing cylinder (15) in order to transmit a pressure change, generated in the first pressure chamber (18) by means of the eccentric drive (11), to the second pressure chamber (20).

2. The tamping unit (1) according to claim 1, wherein an approximately equal relationship of force transmission from the respective squeezing cylinder to the associated tamping tool (6) exists, and wherein the two squeezing cylinders are controlled in a diametrically opposed manner.

3. The tamping unit (1) according to claim 1, wherein both squeezing cylinders (9, 15) are oriented approximately horizontally, wherein the tamping tool associated with the first squeezing cylinder (9) has a first mass moment of inertia with respect to a pivot axis, wherein the tamping tool associated with the second squeezing cylinder has a second mass moment of inertia with respect to a pivot axis, and wherein both mass moments of inertia are coordinated with one another.

4. The tamping unit (1) according to claim 1, wherein the tamping unit (1) is composed of several individual unit modules (30, 31) to form a multi-sleeper unit.

5. The tamping unit (1) according to claim 4, wherein two first squeezing cylinders (9) are connected mechanically to a common eccentric drive (11), and wherein each first squeezing cylinder (9) is connected hydraulically to a second squeezing cylinder (15).

6. The tamping unit (1) according to claim 1, wherein the connecting line (22, 27) is connected via a pressure diaphragm (26, 28) to a hydraulic system.

7. The tamping unit (1) according to claim 1, wherein an amplitude of an eccentric shaft (12) is split evenly between both squeezing cylinders (9, 15).

* * * * *